United States Patent [19]

Savage, Jr.

[11] Patent Number: 5,068,771

[45] Date of Patent: Nov. 26, 1991

[54] REFLECTOR LENS CAP AND/OR CLIP FOR LED

[76] Inventor: John M. Savage, Jr., 538-B Via Del La Valle, Solana Beach, Calif. 92075

[21] Appl. No.: 692,617

[22] Filed: Apr. 29, 1991

[51] Int. Cl.[5] ..... F21M 3/14

[52] U.S. Cl. ..... 362/255; 362/296; 362/396; 362/800

[58] Field of Search ..... 362/226, 296, 255, 256, 362/341, 396, 800

[56] References Cited

U.S. PATENT DOCUMENTS

| | | | |
|---|---|---|---|
| 3,774,021 | 11/1973 | Johnson | 313/108 D X |
| 3,887,803 | 6/1975 | Savage, Jr. | 174/138 G X |
| 4,035,681 | 6/1977 | Savage, Jr. | 313/110 |
| 4,195,330 | 3/1980 | Savage, Jr. | 362/226 |
| 4,398,240 | 8/1983 | Savage, Jr. | 362/311 |
| 4,402,110 | 9/1983 | Savage, Jr. | 16/225 |
| 4,471,414 | 9/1984 | Savage, Jr. | 362/226 |
| 4,491,900 | 1/1985 | Savage, Jr. | 362/230 |
| 4,599,682 | 7/1986 | Stephens | 362/800 X |
| 4,727,648 | 3/1988 | Savage, Jr. | 29/839 |
| 4,837,927 | 6/1989 | Savage, Jr. | 29/839 |
| 4,868,719 | 9/1989 | Kouchi et al. | 362/800 X |
| 4,947,291 | 8/1990 | McDermott | 362/800 X |

*Primary Examiner*—Stephen F. Husar
*Attorney, Agent, or Firm*—William W. Haefliger

[57] ABSTRACT

A light-emitting diode assembly attachable to a display panel, the assembly comprising a light-emitting diode having locking structure thereon, the structure defining a boss; a lens cap receiving the diode forwardly therein, and clip structure integral with the cap and projecting sidewardly proximate the diode locking structure; the clip structure defining spring fingers projecting rearwardly at the side of the diode, the fingers defining first grooves to receive the boss on the diode, and second grooves to receive portions of the display panel adjacent an opening formed therein; the lens cap being annular, and including a light-reflecting surface on the lens cap extending about forward extent of the diode, forwardly of the spring fingers, and angled to reflect rays from the diode in a generally forward direction.

18 Claims, 4 Drawing Sheets

18d
11
113b
113a
116
20
13
162a
160
162
17
15
12
115
23
14
10a
19
118
11a 118
113b
113a
12

20c
20b
118
26c
26
26b
100
20a
20d
11

REFLECTOR LENS CAP AND/OR CLIP FOR LED

BACKGROUND OF THE INVENTION

This invention relates generally to light-emitting devices and apparatus; more specifically, it concerns light-transmitting enhancement in relation to installation or mounting of such devices, to overcome prior problems and difficulties.

In the past, and as shown in U.S. Pat. No. 4,195,330, lens caps have been installed to extend about and across the forward ends of diodes and LEDS. Such caps were provided with serrations and ribs to provide walls that refracted light from the diode, in an effort to provide increased luminosity of local areas of the cap; however, light transmitted sidewardly from the diode was not efficiently captured to be re-transmitted forwardly; also, such caps added to the overall structure needed to mount the diode.

There is need for means to efficiently capture light transmitted sidewardly from the sides of LEDs and to retransmit such light forwardly for enhancement, luminosity. Also, there is need to arrange light transmission from the diode so as to enlarge the perceived size of the diode.

SUMMARY OF THE INVENTION

It is a major object of the invention to provide an assembly offering a solution to the above needs and difficulties. Basically, the improved assembly of the invention includes:

a) a light-emitting diode having locking structure thereon, the structure defining a boss, b) a lens cap receiving the diode forwardly therein, and clip means integral with the cap and projecting sidewardly proximate the diode locking structure, c) the clip means defining spring fingers projecting rearwardly at the side of the diode, the fingers defining first grooves to receive the boss on the diode, and second grooves to receive portions of a display panel adjacent an opening formed therein, and wherein, d) the lens cap is annular, and a light-reflecting surface is provided on the lens cap extending about forward extent of the diode, forwardly of the spring fingers, to reflect light rays from the diode in a generally forward direction.

It is another object to provide the cap and reflective surface to extend radially outwardly of a forwardly extending cylinder defined by the spring fingers, to enlarge the perceived size of the LED. The fingers have radially outermost surfaces outwardly of the diode-locking structure, and the cylinder is typically tangent to those outermost surfaces.

Another object is to provide the reflective surface to have frusto-conical extent relative to a forward central axis defined by the clip means.

That surface in one embodiment extends about domed extent of the diode and tapers rearwardly toward medial extent of the diode; and in another form that surface extends directly about a cylindrical side wall of the diode.

In yet another embodiment, the reflective surface lies rearwardly of the domed forward extent of the diode and extends generally radially.

As will be seen, the reflective surfaces collect light transmitted sidewardly from the diode to transmit such light generally forwardly; the diode forward extent openly transmits light forwardly for highest efficiency, and that light transmission is enhanced by light transmission from the reflective surface, which also has the effect of increasing the intensity and/or perceived size of the LED.

DRAWING DESCRIPTION

DETAILED DESCRIPTION

Figure 1:
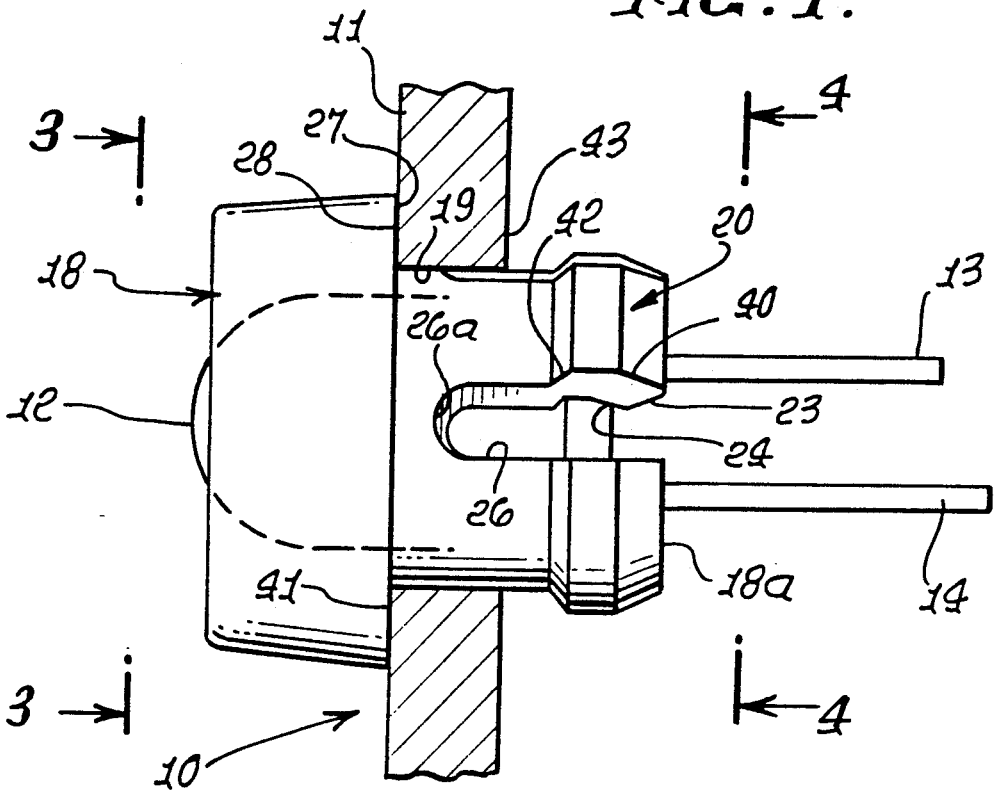
FIG. 1 is a side elevation showing an LED in relation to reflective surface structure.
Figure 2:
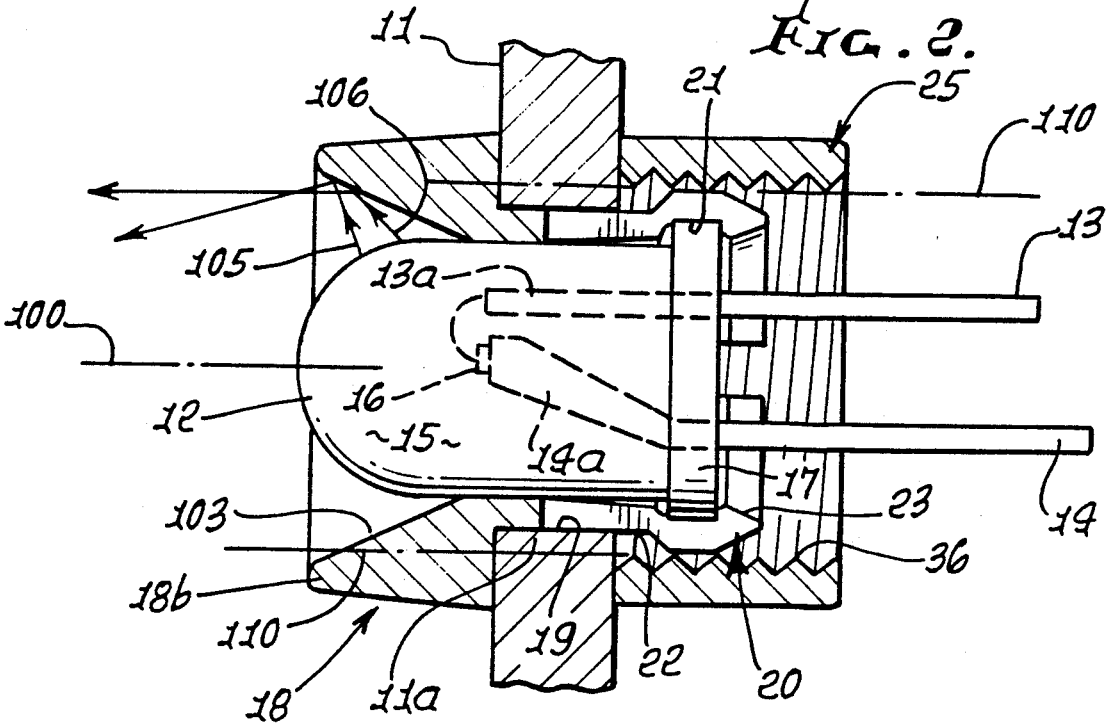
FIG. 2 is a section taken through the FIG. 1 LED and reflective surface.
Figure 3:
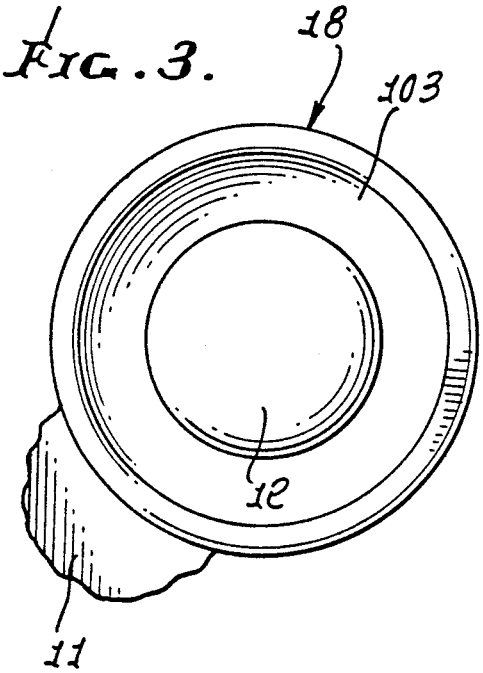
FIG. 3 is an end view taken on lines 3—3 of FIG. 1.
Figure 4:
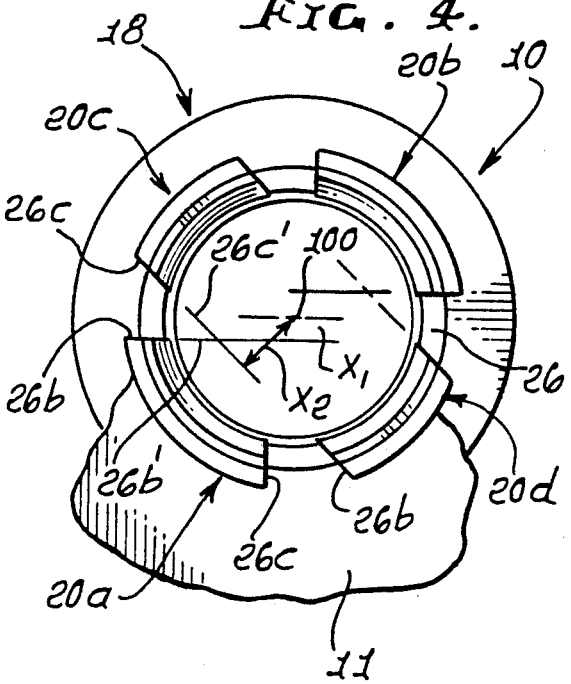
FIG. 4 is an end view taken on lines 4—4 of FIG. 1.

The light-emitting diode assembly 10 seen in FIGS. 1–4 is attached to display panel 11. The LED 12 includes terminals 13 and 14 projecting rearwardly from housing 15, and also within the latter at 13*a* and 14*a*. A luminous chip 16 defines the light-emitting zone of the LED. The LED also includes locking structure, as for example arcuate boss or flange section 17, at the rearward side of the panel 11.

The assembly also includes a lens cap 18 receiving the diode, and clip means integral with the cap projecting proximate the LED locking structure. The lens cap projects axially at the front side of the panel, and the LED or diode 12 projects axially forwardly through an opening 19 in the panel 11 and within the cap, also at the front side of the panel. The clip means may, with unusual advantage, comprise spring fingers 20 projecting rearwardly through panel opening 19 at the outer side of the diode; further, the spring fingers have tongue and groove interfit with the diode, at the rear side of the panel. The illustrated interfit or releasable interconnection is defined by the reception of the radially projecting boss 17 into inwardly facing first grooves 21 defined by cantilevered extents of the fingers projecting rearwardly of the panel 11. Note that the spring fingers also define outwardly facing second grooves 22 receiving portions 11*a* of the panel 11 adjacent the circular opening 19.

The fingers 20 further define first cam surfaces 23 located rearwardly of the grooves 21 to be radially spread by the diode boss 17 in response to forward insertion of the diode into the cap. Surfaces 23 are angled rearwardly and radially outwardly, as shown. In addition, the fingers define second cam surfaces 24 immediately rearward of the grooves 21 and angled rearwardly and radially inwardly to be radially spread apart by the diode boss 17 in response to relatively rearward retraction of the diode from the cap.

Retention of the diode boss 17 in grooves 21 is assured by a retainer urging the clip means spring fingers into interfitting relation with the diode locking structure, i.e., boss 17. As shown, the retainer may comprise a ring 25 having a circumferentially serrated bore 36 in forcible frictional engagement with the spring fingers.

It should be noted that four spring fingers 20 may be provided by forming four lengthwise extending slits 26 in the skirt portion of the cap, at 90° intervals about the cap axis. The slits extend forwardly or leftwardly from the rightward end 18*a* of the cap. The leftward ends 26*a* of the slits terminate within the bore or opening 19 in the display panel, and to the right of an annular cap shoulder 27 which seats against the face 28 of the panel, and which defines the leftward end of groove 22. The cap is held in that seated position by the frictional grip of the retainer serrations 36 against the spring fingers. In that position, the cap holds the diode itself so that the light zone defined by luminous chip 16 is proximate the plane defined by panel face 28.

Note that each slit 26 has two side walls **26*b* and 26*c*. Wall 26*b* extends in a plane 26*b*' offset at $X_1$ from axis 100; and wall 26*c* extends in a plane 26*c* ' crossing plane 26*b*' and offset at $X_2$ from axis 100, where $X_2 > X_1$. This provides greater arcuate lengths of two of the opposed spring fingers 20*a* and 20*b*, for enhanced spring resistance to deflection, and lesser arcuate lengths of the opposed fingers 20*c* and 20*d*. See FIG. 4**.

FIG. 1 also shows that the spring fingers 20 define third outwardly facing cam surfaces 40 rearwardly of the second grooves 22, and angled rearwardly and radially inwardly to be urged radially inwardly by edge portions 41 of the panel in response to rearward installation of the spring fingers through the opening 19; also, the fingers define fourth cam surfaces 42 rearwardly of and adjacent the grooves 22, surfaces 42 being angled rearwardly and radially outwardly to be urged inwardly by edge portions 43 of the panel in response to forward retraction of the fingers through opening 19. Accordingly, the spring fingers accommodate ready installation of the lens cap 18 to a panel, as well as ready removal of the cap from the panel, without the diode being located within the cap; and ready installation of the diode into the installed cap as well as ready removal of the diode from the installed cap.

The lens cap and clip means describe herein, and the retainer ring, may consist of any suitable plastic material.

It is an important feature of the invention that the lens cap 18 is annular, and includes a light-reflecting surface on the cap to extend about forward domed extent of the diode, forwardly of the spring fingers. See for example cap annular extent **18*b* about the domed forward extent of the diode in FIGS. 1 and 2, and reflective surface 103 facing forwardly and inwardly toward the diode dome. Reflective surface 103 is typically metallic (for example chrome plate on a plastic cap body) and annular, and defines a frusto-conical shape relative to central axis 100 defined by the clip means; also, surface 103 tapers rearwardly toward medial extent of the diode. See FIG. 2. That view also shows two light rays 105 and 106 emanating sidewardly from the diode, and reflected to be transmitted generally forwardly from the surface 103 to enhance or add to the forward light transmission of the diode, achieving forward brilliance of the optically perceived visibility of the diode, and also enlarging its effective light-transmitting perimeter to a forwardly extending cylinder 110 about axis 100. Cylinder 100 intersects the forwardmost extent of the surface 103, as shown. Note also that cylinder 110 typically is tangent to outermost extents of the diode locking structure, i.e., the fingers, in FIGS. 1 and 2. Surface 103** is typically plated onto the cap surface, and may consist of chromium or other metal.

Figure 5:
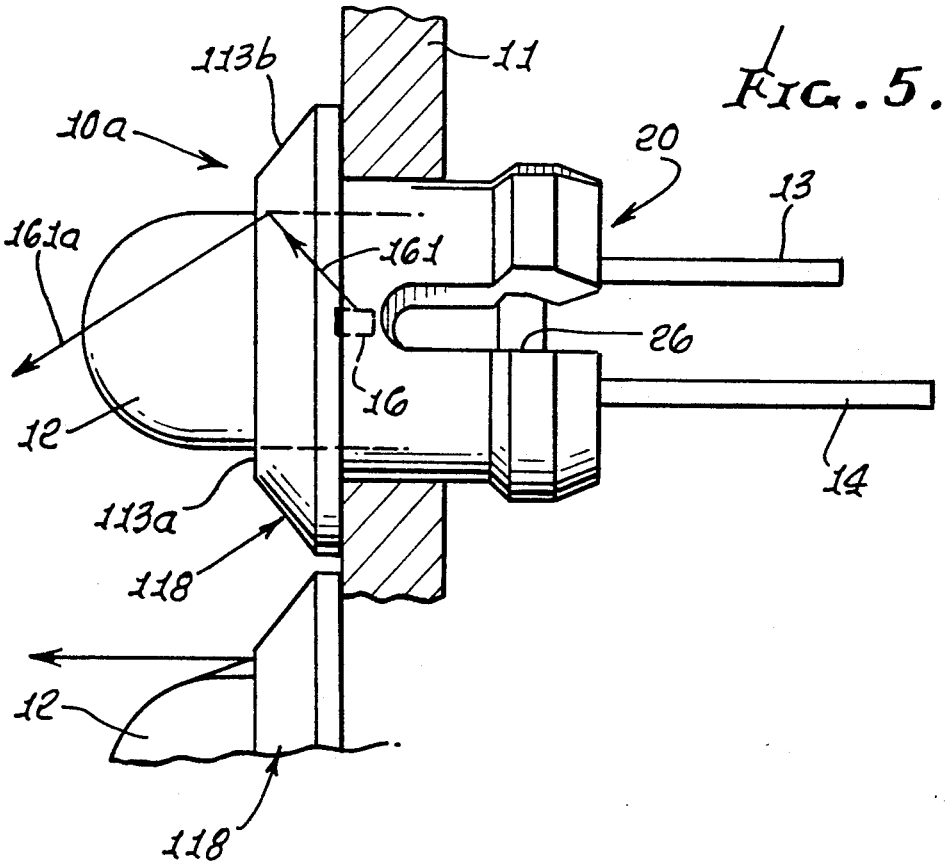
FIGS. 5–8 are views like FIGS. 1–4, respectively, and showing a modification.
Figure 6:
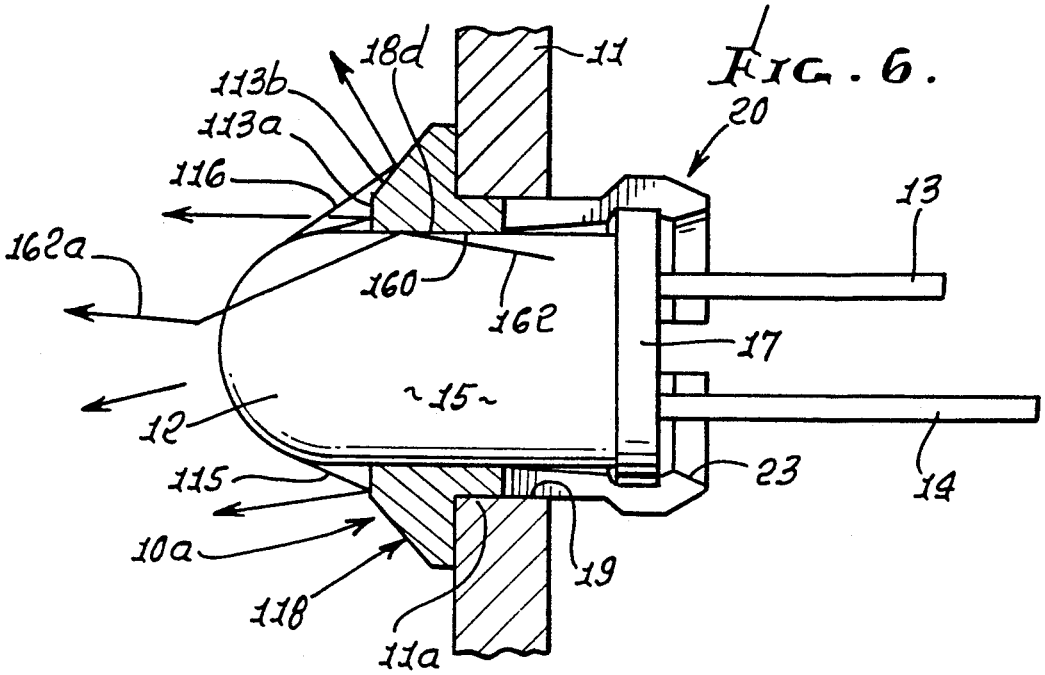
Figure 7:
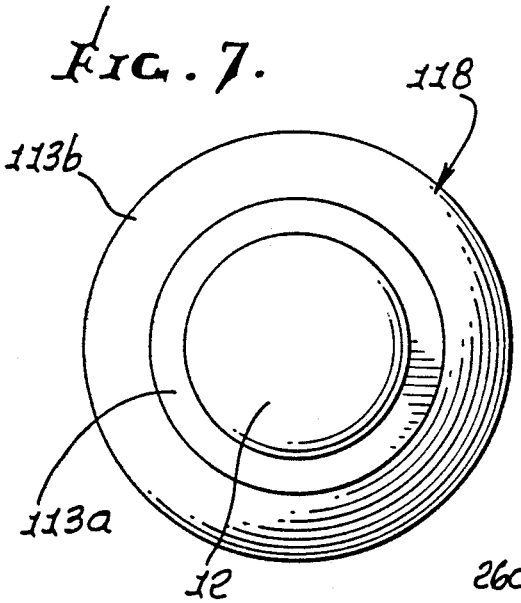
Figure 8:
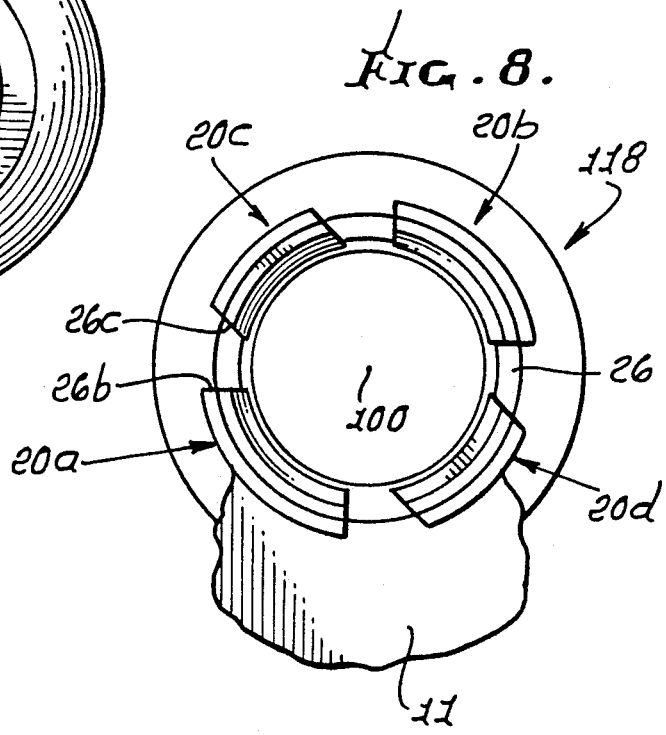

In FIGS. 5–8, the elements of structure the same as those shown in FIGS. 1–4 bear the same identifying members. In this modified assembly **10*a* example, the lens cap 118 is again annular, but extends about the generally cylindrical side wall 18*d* of the diode, rearwardly of its forward domed extent. The reflective surfaces provided on the cap may include annular forward facing surface 113*a* which extends generally radially, and frusto-conical forward facing surface 113*b*, which intersects surface 113*a* and tapers toward a zone associated with the forwardmost domed extent of the diode. Light rays 115 from the diode are reflected generally forwardly, from surface 113*a*; and light rays 116 from the diode are reflected outwardly and forwardly by surface 113*b* to achieve an enlargement of the diode source of forward light transmission. Another like and adjacent diode 12 is shown in FIG. 5, attached to the same panel. In addition, the bore surface of the cap has a reflective cylindrical surface 160 facing the side of the diode to collect diode sidewardly-emitted light and reflect it forwardly through domed wall 12. See ray 161 in FIG. 5 reflected forwardly at 161*a*, and ray 162 in FIG. 6 reflected forwardly at 162*a* through dome 12**.

Figure 9:
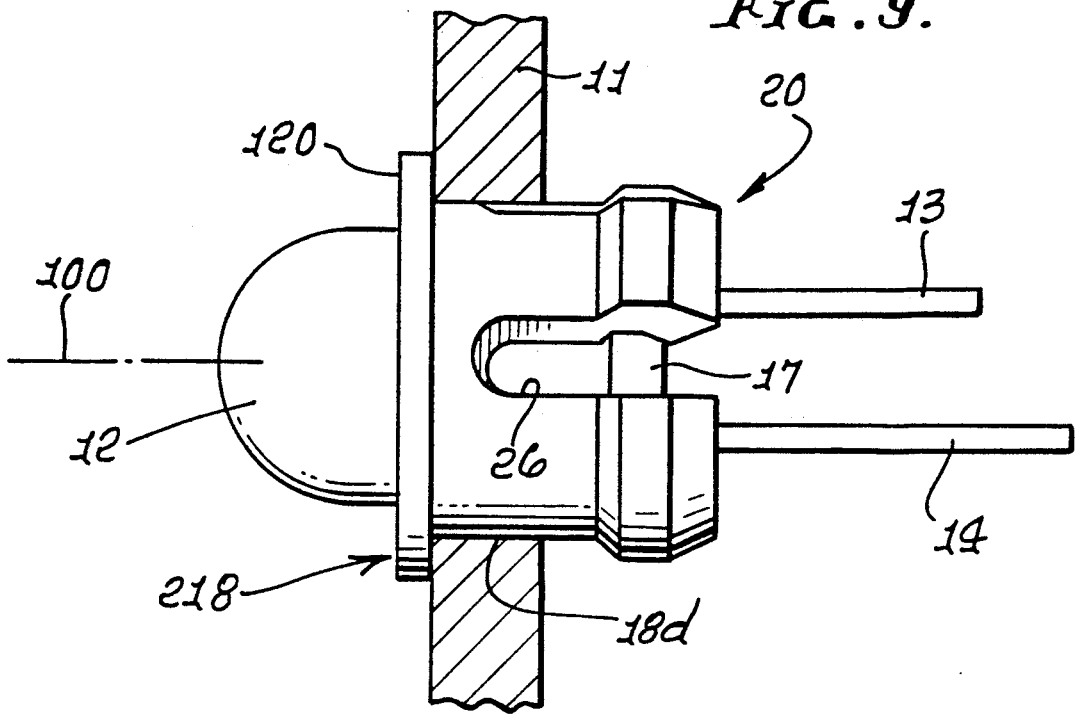
FIGS. 9 and 10 are views like FIGS. 1 and 2, respectively, and showing another modification.
Figure 10:
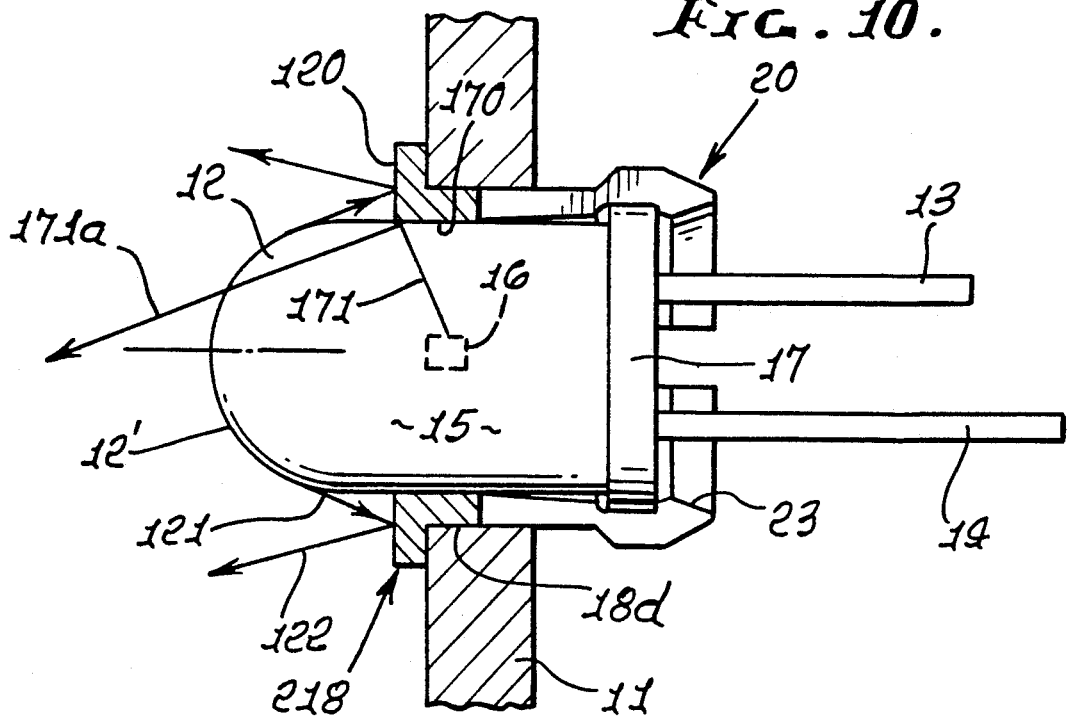

In FIGS. 9 and 10, the structural elements the same as shown in FIGS. 1–4 bear the same numerals. The lens cap 218 is again annular but extends about the side wall **18*d* of the diode. Reflective surface 120 on the cap faces forwardly and extends in a plane normal to axis 100. Surface 120 is spaced rearwardly of domed forwardmost extent 12' of the diode. Light rays 121 that emanate from the forward side of the diode are reflected at 122 and are transmitted generally forwardly, with the results as described above, diode forward light transmission being enhanced, and the light transmission perimeter increased. Reflective bore of the cap, at 170, reflects light forwardly. See ray 171 reflected at 171*a***.

I claim:

1. In a light-emitting diode assembly attachable to a display panel, said assembly comprising:

a) a light-emitting diode having locking structure thereon, said structure defining a boss, b) a lens cap receiving the diode forwardly therein, and clip means integral with the cap and projecting sidewardly proximate the diode locking structure, c) said clip means defining spring fingers projecting rearwardly at the side of the diode, the fingers defining first grooves to receive the boss on the diode, and second grooves to receive portions of the display panel adjacent an opening formed therein, d) said lens cap being annular, and including a light-reflecting surface on said lens cap extending about forward extent of the diode, forwardly of said spring fingers, and oriented to reflect light rays from the diode in a generally forward direction.

2. The assembly of claim 1 wherein said cap and said reflecting surface thereon extend outwardly of a forwardly extending cylinder defined by said spring fingers.

3. The assembly of claim 2 wherein said spring fingers have radially outermost surfaces outwardly of said diode-locking structure, said cylinder tangent to said outermost surfaces.

4. The assembly of claim 1 wherein said reflective surface has frusto-conical extent relative to a forward central axis defined by said clip means.

5. The assembly of claim 1 wherein said cap and said reflective surface extend protectively about forward extent of the diode, the diode openly forwardly exposed through the cap, said reflective surface facing the diode to receive light from the diode and reflect that light forwardly.

6. The assembly of claim 1 wherein said cap and clip structure consist of molded plastic material, there being metallic plating on the cap defining said reflective surface.

7. The assembly of claim 4 wherein said surface tapers toward medial extent of the diode received in said clip structure.

8. The assembly of claim 4 wherein said reflective surface extends generally cylindrically about the diode, the diode having a domed forward extend projecting forwardly of said reflective surface.

9. Multiple assemblies, as defined in claim 8 and attached to a panel, and arranged so that said reflective surfaces project forwardly of said panel and provide means for enhancing the forwardly projected light from the diodes.

10. The assembly of claim 7 wherein said reflective surface extends about forwardly domed extent of the diode and is spaced therefrom.

11. The assembly of claim 8 wherein said reflective surface extends about a side wall of the diode, rearwardly of said domed forward extent thereof.

12. The assembly of claim 1 wherein the spring fingers define first cam surfaces rearwardly of the reflective surface, and of the first grooves, and angled to be radially spread by the diode boss in response to forward insertion of the diode into the cap.

13. The assembly of claim 1 including a retainer having the form of a ring receiving and extending about said fingers, in rearward alignment with said reflective surface.

14. The assembly of claim 1 including said panel having said opening therethrough, said lens cap interfitting the panel and projecting into said opening, said diode openly exposed forwardly through the lens cap.

15. The assembly of claim 3 wherein the retainer engages the panel, rearwardly of the reflective surface.

16. The assembly of claim 1 wherein said reflective surface is a metallic coating on the cap body which consists of plastic material.

17. The assembly of claim 16 wherein said coating consists of chromium.

18. In combination:

a) a light-emitting diode having a cylindrical side wall and a forwardly projecting domed wall, b) a sleeve extending about the diode side wall, the sleeve having a light reflective cylindrical surface bounding and adjacent the diode side wall to reflect light from the diode forwardly through the diode forwardly projecting domed wall.

* * * * *